US011686137B2

(12) United States Patent
Girard et al.

(10) Patent No.: US 11,686,137 B2
(45) **Date of Patent: *Jun. 27, 2023**

(54) GATE SUPPORTIVE, SIGNAL TRANSMITTING HINGE

(71) Applicant: ERGOMAT, INC., Lorain, OH (US)

(72) Inventors: John Joseph Girard, Lakewood, OH (US); Claus Munch Lendal, Avon Lake, OH (US)

(73) Assignee: ERGOMAT, INC, Lorain, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/488,122

(22) Filed: Sep. 28, 2021

(65) Prior Publication Data

US 2022/0018172 A1 Jan. 20, 2022

Related U.S. Application Data

(63) Continuation of application No. 16/113,690, filed on Aug. 27, 2018, now Pat. No. 11,131,132.

(60) Provisional application No. 62/606,580, filed on Sep. 28, 2017.

(51) Int. Cl.

| | |
|---|---|
| ***E05D 11/00*** | (2006.01) |
| ***E05D 3/02*** | (2006.01) |
| ***G08B 7/06*** | (2006.01) |
| *E05D 7/04* | (2006.01) |

(52) U.S. Cl.

CPC ..... *E05D 11/00* (2013.01); *E05D 3/02* (2013.01); *E05D 11/0081* (2013.01); *G08B 7/06* (2013.01); *E05D 7/04* (2013.01); *E05Y 2400/664* (2013.01); *E05Y 2900/40* (2013.01)

(58) Field of Classification Search

None

See application file for complete search history.

(56) References Cited

U.S. PATENT DOCUMENTS

| | | | | |
|---|---|---|---|---|
| 3,803,375 | A * | 4/1974 | Foltz | H01H 3/162 200/61.7 |
| 9,431,927 | B2 * | 8/2016 | Hoff | E06B 7/23 |
| 11,131,132 | B2 * | 9/2021 | Girard | E05D 3/02 |
| 2007/0268132 | A1 * | 11/2007 | Milo | E05B 47/02 340/545.1 |
| 2011/0252845 | A1 * | 10/2011 | Webb | E06B 7/28 290/1 R |

* cited by examiner

*Primary Examiner* — Rodney E Fuller
(74) *Attorney, Agent, or Firm* — David A. Burge; Benjamin D. Burge

(57) ABSTRACT

A hinge has a first component that pivotally supports a second component of the hinge. The first hinge component carries an energy harvesting switch having a movable operator such as a spring-projected plunger that is positioned to be depressed or otherwise moved by the second hinge component in response to relative pivotal movement of the first and second hinge components. If a gate is fastened to the second hinge component, at least some of the weight of the gate is transferred from the second hinge component to the first hinge component. When the gate is pivoted away from a closed orientation toward an open orientation, the second hinge component moves the operator of the energy harvesting switch thereby causing the energy harvesting switch to emit a radio frequency signal.

16 Claims, 4 Drawing Sheets

GATE SUPPORTIVE, SIGNAL TRANSMITTING HINGE

REFERENCES TO RELATED APPLICATIONS

This utility application is a continuation of U.S. patent application Ser. No. 16/113,690 filed Aug. 27, 2018 by John Joseph Girard and Claus Munch Lendal, and entitled GATE SUPPORTIVE, SIGNAL TRANSMITTING HINGE, the disclosure of which is incorporated herein by reference in its entirety for all purposes. In turn, U.S. patent application Ser. No. 16/113,690 claims the benefit of the filing date of Provisional Application 62/606,580 filed Sep. 28, 2017 by the inventors hereof, entitled GATE-OPERATED KINETIC ENERGY SWITCHES, the disclosure of which is also incorporated herein by reference in its entirety for all purposes.

BACKGROUND

Many hinges of a wide variety of sizes and configurations are known that utilize three primary components, including a pair of interleaved "halves" of the hinge that cooperate to define aligned passages through which a third hinge component, namely a hinge pin, extends to pivotally connect the interleaved hinge "halves" for relative pivotal movement about an axis of the hinge pin.

Simpler hinges also are known that have only two primary hinge components, including a first hinge component that defines a generally cylindrical, substantially vertically extending passage into which a generally cylindrical formation of the second hinge component depends. Substantially flat, substantially horizontally extending surfaces of these first and second hinge components engage when the generally cylindrical formation of the second hinge component depends as far as is permitted into the generally cylindrical passage defined by the first hinge component.

By virtue of the engagement of these substantially flat surfaces, the first hinge component supports the second hinge component for relative pivotal movement about a substantially vertically extending center axis of the generally cylindrical passage. If a gate is fastened to and is supported by the second hinge component, at least some of the weight of the gate is transferred from the second hinge component to the first hinge component due to the engagement of the substantially flat, substantially horizontally extending surfaces of the first and second hinge components.

Hinges that embody the preferred practice of the present invention utilize the "simpler hinge" configuration just described. Additionally, each hinge that embodies the preferred practice of the present invention includes what has come to be known as an "energy harvesting switch" that, when operated due to relative pivotal movement of the two components of the hinge, emits a radio frequency signal.

Such energy harvesting switches as are referred to in this document include both a housing that protectively encloses a wireless radio frequency transmitter, and a plunger or other form of movable "operator" that, when depressed or otherwise moved relative to the housing of the switch, causes the wireless radio frequency transmitter carried within the housing of the switch to emit a radio frequency signal that can be received by a remotely located warning device, or the like, to cause the warning device to display a visible signal, and/or to sound an audible signal that is indicative of the operation of the energy harvesting switch—which, as is explained just above, can warn of the opening of a gate fastened to the second of two components of a "simpler" style of hinge that is explained above.

A significant advantage of so-called energy harvesting switches is that they do not need to be supplied by a battery or other source of electrical energy in order to emit a radio frequency signal of sufficient strength to be received as much as half a mile from the location of the energy harvesting switch. This means that gates (and the like) that are fastened to a hinge that incorporates an energy harvesting switch do not need to be "hard wired" to supply electrical energy to the mounting arrangement of the gates, thereby simplifying the installation of such gates, and diminishing the cost of such installations.

One commercially available source of energy harvesting switches is CHERRY ENERGY HARVESTING SOLUTIONS which is understood to have been acquired by ZP Electronic Systems of Pleasant Prairie, Wis. 53158. A type of Energy Harvesting Switch shown in the drawings hereof is Model AXIS-5002 which emits a 915 Maze radio frequency signal.

As those who are skilled in the art will readily appreciate, other types of energy harvesting switches can also be used with gate-supportive-capable hinges of the type disclosed herein, so long as such energy harvesting switches have a plunger or other form of "operator" that can be moved relative to a housing of such switches to cause an energy harvesting radio frequency transmitter protectively enclosed by the housing of such switches to emit a radio frequency signal in response to movement of the plunger or "operator" relative to the housing of such switches.

Many patents have been obtained worldwide that disclose and claim various features of so-called energy harvesting switches. U.S. patents that disclose energy harvesting switches (and that reference foreign patents which also disclose a variety of forms energy harvesting switches) include U.S. Pat. No. 9,552,937 issued Jan. 24, 2017 to Erdmann et al; U.S. Pat. No. 7,019,241 issued Mar. 28, 2006 to Grassi et al; U.S. Pat. No. 6,933,655 issued Aug. 23, 2005 to Morrison et al; and U.S. Pat. No. 6,700,310 issued Mar. 2, 2004 to Maue et al. The disclosures of all of these U.S. and foreign patents are incorporated herein by reference.

SUMMARY

Hinges that embody the preferred practice of the present invention are of the two-component "simpler" type that is referred to above—in that a first hinge component of the hinge defines a generally cylindrical, substantially vertically extending passage, into which a generally cylindrical formation of a second hinge component depends—by which arrangement the first and second hinge components are connected for relative pivotal movement about a substantially vertically extending central axis of the generally cylindrical passage.

Hinges that embody the preferred practice of the present invention also have a cam defined by the generally cylindrical formation of the second hinge component—a cam that is configured to cause a spring-projected plunger (or other movable operator of an energy harvesting switch) to be depressed or otherwise moved relative to a housing of the switch in response to relative pivotal movement of the first and second components of the hinge.

If a gate is fastened to the second hinge component, pivotal movement of the gate away from a "closed" orientation of the gate toward an "open" orientation of the gate, causes the energy harvesting switch to emit a radio frequency signal that can be received by a warning device to cause emission of an audible warning signal, and/or to cause a visual signal to be displayed, which signals are indicative of opening movement of the gate.

BRIEF DESCRIPTION OF THE DRAWINGS

These and other features, advantages and objectives of the present invention will become apparent from the description and claims that follow, taken together with the accompanying drawings, wherein:

In FIGS. 7 and 8, portions of a wooden gate, a wooden support, and two plastic hinge components are broken away and shown in cross-section to permit wood screws that fasten the plastic hinge components to the wooden gate and to the wooden support to be seen.

DETAILED DESCRIPTION

Figure 1:
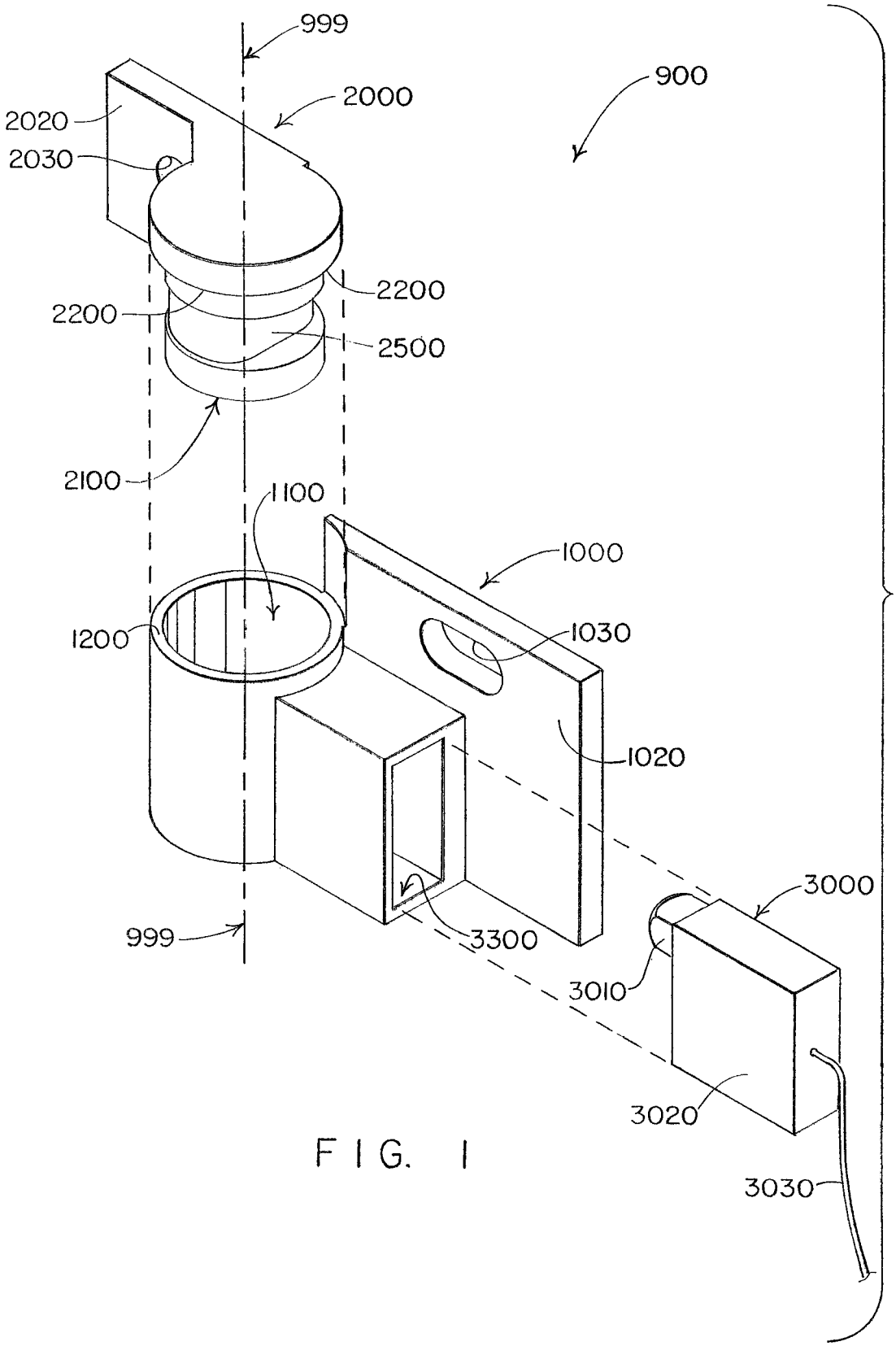
FIG. 1 is an exploded perspective view showing first and second components of a hinge that embodies one preferred practice of the present invention, including a spring-projected plunger type of operator that extends from one end region of the housing, and a flexible antenna that extends from an opposite end region of the housing for transmitting a radio frequency signal in response to the plunger being depressed toward and into the housing of the energy harvesting switch.
Figure 2:
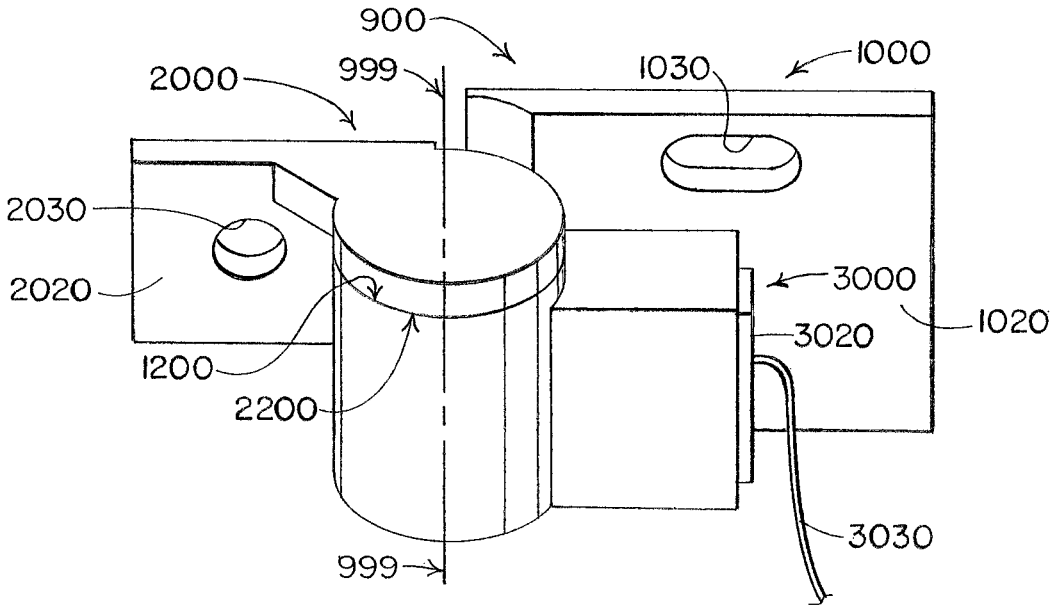
FIG. 2 is a perspective view showing the first and second hinge components assembled, with a generally cylindrical, substantially vertically extending passage of the first hinge component receiving a generally cylindrical formation of the second hinge component that depends into the generally cylindrical passage, with the energy harvesting switch extending into and being carried within a generally rectangular passage that is also defined by the first hinge component.
Figure 3:
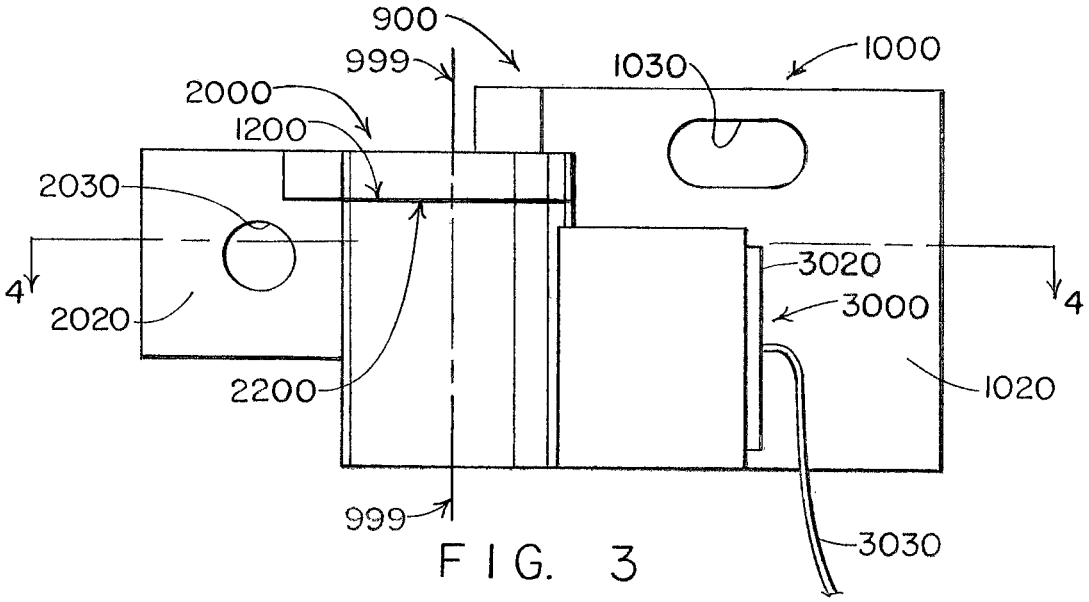
FIG. 3 is a front view of the assembled components that are shown in FIG. 2.

Referring to FIG. 1, a two-part hinge 900 has a first hinge component 1000 and a second hinge component 2000 that can pivot relative to each other about a hinge axis 999 when the two hinge components 1000 and 2000 are assembled in the manner shown in FIG. 2.

As can be seen in FIG. 1, the first hinge component 1000 defines a substantially vertically extending, generally cylindrical passage 1100 into which a substantially vertically extending, generally cylindrical formation 2100 of the second hinge component depends when the first and second hinge components 1000 and 2000 are assembled in the manner shown in FIG. 2.

As can also be seen in FIG. 1, the first hinge component 1000 has a substantially flat, upwardly-facing surface 1200 defined by the upper end region of the vertically extending passage 1100. When the first and second components 1000, 2000 of the hinge 900 are assembled as is depicted in FIG. 2, the substantially flat upper surface 1200 of the first hinge component 1000 is engaged by a downwardly-facing annular surface 2200 of the second hinge component 2000. The flat surfaces 1200, 2200 extend in a horizontal plane—which is to say that the flat surfaces 1200, 2200 extend substantially perpendicular to the substantially vertically extending hinge axis 999.

As can additionally be seen in FIG. 1, the first and second hinge components 1000, 2000 have elongate formations 1020, 2020 that extend rightwardly and leftwardly, respectively, from the vertically extending hinge axis 999. The elongate formations 1020, 2020 have openings 1030, 2030 formed therethrough, respectively, that can permit portions of such threaded fasteners 1010, 2010 as are shown in FIGS. 7 and 8 to extend therethrough to fasten the first and second hinge components 1000, 2000 to an upstanding support 1040, and to a preferably relatively lightweight gate 2040, respectively, portions of which are also shown in FIGS. 7 and 8.

Figure 7:
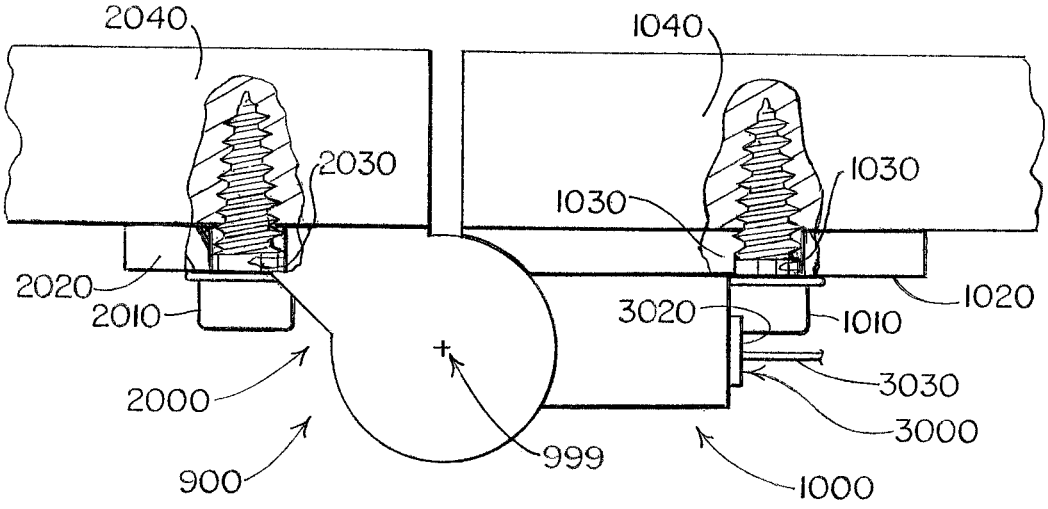
FIG. 7 is a top view of the assembled hinge components, with one of the two hinge components connected to a gate, and with the other hinge component connected to an upstanding support.
Figure 8:
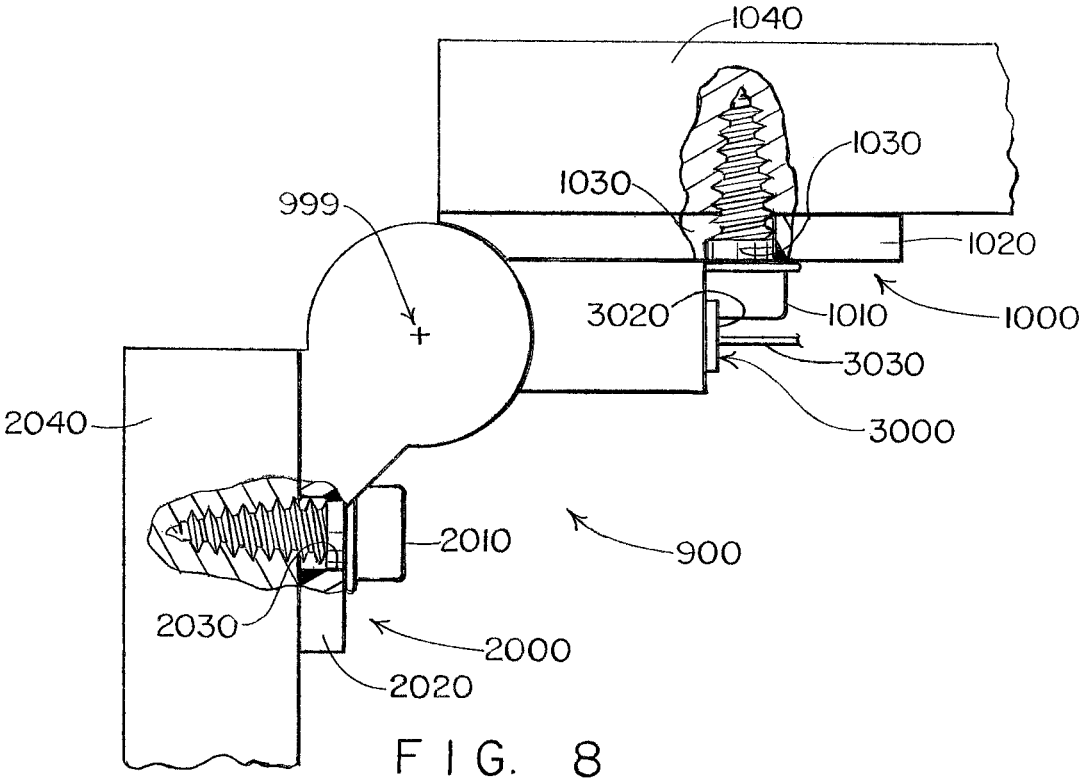
FIG. 8 is a top view similar to FIG. 7, but with one of the hinge components (and the attached gate) turned approximately ninety degrees relative to the orientation of the other hinge component as depicted in FIG. 7.

As will become apparent by comparing the positions of the gate 2200 as shown in FIGS. 7 and 8, the gate 2200 can be pivoted about the substantially vertically extending hinge axis 999 through a range of angular movement of at least about ninety degrees from a closed orientation depicted in FIG. 7, to an open orientation of the gate 2200 as depicted in FIG. 8.

The engagement of the substantially flat surfaces 1200, 2200 of the first and second hinge components 1000, 2000, respectively, not only limits how far the generally cylindrical formation 2100 can depend into the generally cylindrical passage 1100, but also serves to transfer the weight of the second hinge component 2000 to the first hinge component 1000. The engagement of the flat surfaces 1200, 2200 can also transfer at least some of the weight of a gate 2040 (that may be fastened to the second hinge component 2000 as shown in FIGS. 7 and 8) to the upstanding support 1040 (that may be fastened to the first hinge component 1000, as is also shown in FIGS. 7 and 8).

In FIG. 1, the numeral 3000 indicates a commercially available so-called "energy harvesting switch" such as has been available for more than a year from an entity known as CHERRY SWITCHES (also known as CHERRY ENERGY HARVESTING SOLUTIONS) which is understood to have been purchased by ZP Electronic Systems of Pleasant Prairie, Wis. 53158. The particular type of energy harvesting switch 3000 depicted in the drawings hereof is Model AFIS-5002 sold by CHERRY SWITCHES, which transmits a radio frequency signal at approximately 915 MHz when a spring-projected plunger-type operator 3010 of the switch 3000 is depressed into or is otherwise moved relatively toward a housing 3020 of the switch 3000.

As can best be seen in FIG. 1, the plunger-type operator 3010 of the energy harvesting switch 3000 extends from one end region of the housing 3020, and a flexible antenna 3030 extends from an opposite end region of the housing 3020.

Figure 4:
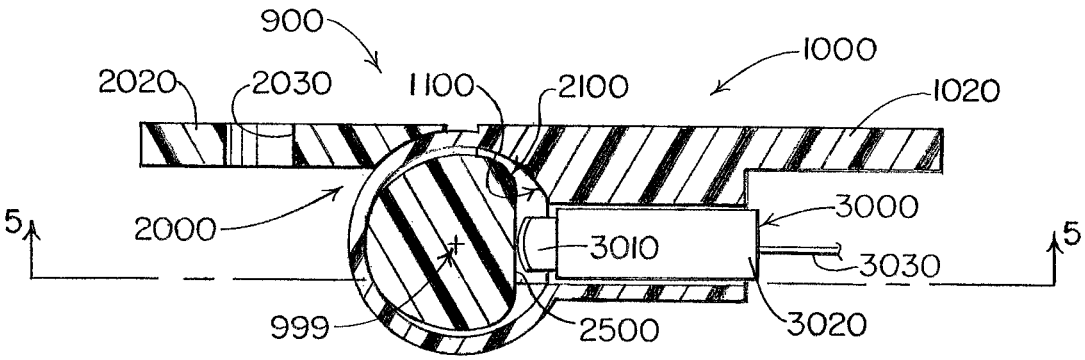
FIG. 4 is a cross-sectional view of the assembled hinge components, as seen substantially from a plane indicated by a line 4-4 in FIG. 3.
Figure 5:
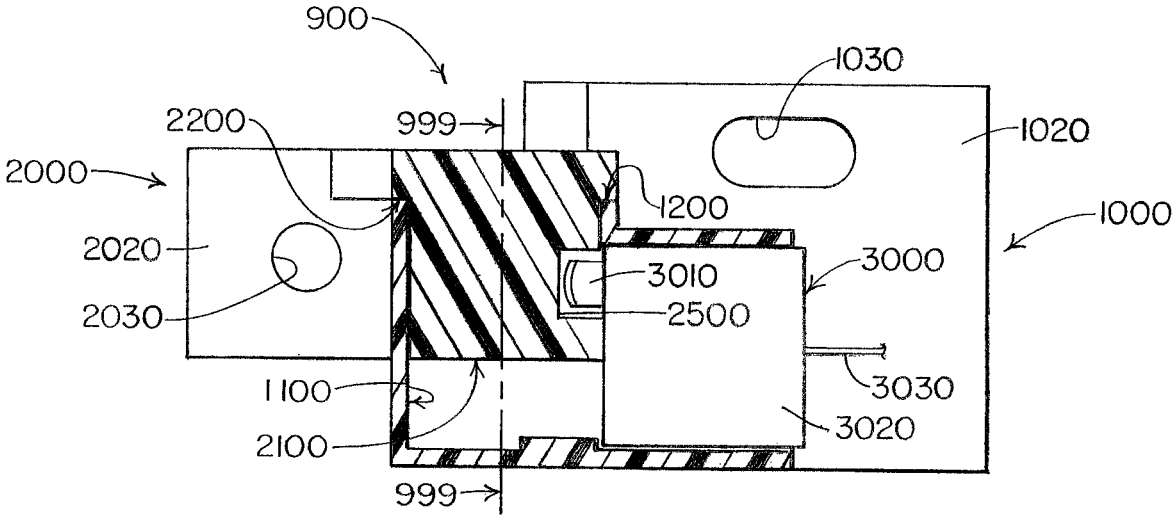
FIG. 5 is a cross-sectional view of the assembled hinge components as seen substantially from a plane indicated by a line 5-5 in FIG. 4.
Figure 6:
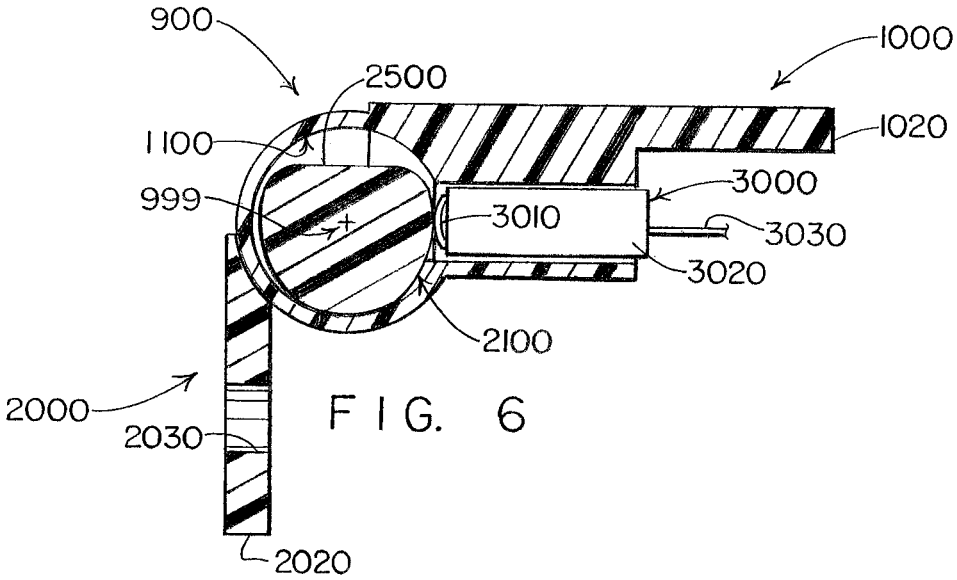
FIG. 6 is a cross-sectional view similar to FIG. 4, but with one of the two hinge components turned approximately ninety degrees relative to other of the two hinge components as depicted in FIG. 4.

As can best be seen in FIGS. 4 and 5, the spring-projected plunger-type operator 3010 of the energy harvesting switch 3000 normally extends about a quarter of an inch from the housing 3020. However, when the first and second hinge components 1000, 2000 are turned from the normally closed orientation shown in FIGS. 4, 5 and 7 to the normally open orientation shown in FIGS. 6 and 8, the plunger-type operator 3010 is moved (by being depressed into the housing 3020 of the switch as is shown in FIG. 6) by a cam 2500 that is defined by the generally cylindrical formation 2100 of the second hinge component 2000.

As is shown in FIGS. 4 and 5, a flat portion of the cam 2500 permits the plunger-type operator 3010 of the energy harvesting switch 3000 to extend nearly a full one-quarter of an inch from the housing of the switch 3000 when the first and second hinge components 1000, 2000, respectively, are in the closed orientation of the first and second hinge components 1000, 2000, respectively. However, when the first and second hinge components 1000, 2000, respectively, pivot relative to each other about the hinge axis 999 to the open orientation shown in FIGS. 6 and 8, a cylindrical portion of the cam 2500 causes the plunger-type operator to be moved by being depressed toward and into the housing 3010 of the switch 3000 as is shown in FIG. 6.

The "closed orientation" of the first and second hinge components 1000, 2000 shown in FIGS. 2-5 also depicts a "closed orientation" of the gate 2040 that is shown in FIG. 7. The "open orientation" of the first and second hinge components 1000, 2000 shown in FIG. 6 also depicts an "open orientation" of the gate 2040 that is shown in FIG. 8.

As can be seen in FIG. 1, the first hinge component 1000 defines a substantially vertically extending, generally cylindrical passage 1012, into which a generally cylindrical formation 2012 of the second hinge component 2000 depends. A substantially flat, upwardly-facing surface 1014 of the first hinge component 1000 is engaged by a substantially flat, downwardly-facing surface 2014 of the second hinge component 2000, to limit how far the generally cylindrical formation 2012 can depend into the generally cylindrical passage 1012 of the first hinge component 1000.

The engagement of the substantially flat surfaces 1014, 2014 not only serves to transfer the weight of the second hinge component 2000 to the first hinge component 1000, but also serves to transfer at least some of the weight of a gate 2040 that is shown as being connected to the second hinge component 2000.

Referring again to FIG. 1, the first hinge component 1000 not only defines the generally cylindrical passage 1012, but also defines a generally rectangular passage 3300 that receives a majority of the housing 3020 of the energy harvesting switch 3000.

When the housing 3020 of the energy harvesting switch 3000 is inserted into the generally rectangular passage 3300 of the first hinge component 1000, a spot of glue or other adhesive (not shown) may be applied to the housing 3020 to assist in retaining the energy harvesting switch 3000 at a desired location within the passage 3300. Alternatively, the passage 3300 can be configured to receive the housing 3020 of the switch 3000 in a press-fit to frictionally retain the housing 3020 of the switch 3000 in the passage 3300.

Inasmuch as the hinge 900 depicted in the drawings hereof is presently comprised of plastics material, the gate 2040 shown in FIGS. 7 and 8 as being fastened to and carried by the hinge 900 is preferably a relatively lightweight element, preferably not exceeding about twenty to twenty-five pounds, so as to not overtax that carrying capacity of the first and second hinge components 1000, 2000. If, instead of forming the hinge components 1000, 2000 from plastics material, the hinge components 1000, 2000 are formed as machined components of metal such as zinc or steel, the gate 2040 fastened to and carried by the second hinge component 2000 can obviously weigh more than only 20 to 25 pounds.

Whereas the drawings of this application depict only one hinge 900 being used to pivotally attach the gate 2040 to the upright support 1040, more than one hinge (not shown) can, of course, be used to supplement the carrying capacity of the one depicted hinge 900.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that such claims as are presented in this document will protect whatever features of patentable novelty as exist in the invention disclosed.

What is claimed is:

1. A hinge comprising a first hinge component that pivotally supports a second hinge component so the first and second hinge components can pivot relative to each other, with the hinge also including an energy harvesting switch (of the type having a housing that encloses a radio frequency transmitter that emits a radio frequency signal in response to movement relative to the housing of an operator of the switch that extends from the housing of the switch), with the housing of the switch being connected to and supported by the first hinge component, and with the second hinge component being configured to cause the operator of the switch to move relative to the housing of the switch in response to relative pivotal movement of the first and second hinge components.

2. The hinge of claim 1 wherein the second hinge component defines a generally cylindrical formation that depends along a substantially vertically extending axis into a generally cylindrical, substantially vertically extending passage defined by the first hinge component to thereby pivotally support the second hinge component from the first hinge component for relative pivotal movement of the first and second hinge components about the substantially vertically extending axis.

3. The hinge of claim 2 wherein the first and second hinge components define substantially flat surfaces that engage to support the second hinge component from the first hinge component when the generally cylindrical formation of the second hinge component depends into the generally cylindrical passage to an assembled position of the first and second hinge components.

4. The hinge of claim 3 wherein the generally cylindrical formation extends as far as possible into the generally cylindrical passage when the substantially flat surfaces engage.

5. A signal-emitting hinge, comprising a first hinge component that pivotally supports a second hinge component for relative pivotal movement, wherein the first hinge component defines a generally cylindrical passage, wherein the second hinge component defines a generally cylindrical formation that depends into the generally cylindrical passage to an assembled position, with the hinge also including an energy harvesting switch that has a housing of the switch connected to and carried by the first hinge component, with the switch also having an operator extending from the housing that is configured and positioned to be moved relative to the housing of the switch by the second hinge component when the first and second hinge components pivot relative to each other to thereby cause the switch to emit a radio frequency signal in response to said relative pivotal movement of the first and second hinge components.

6. The signal-emitting hinge of claim 5 wherein the first and second hinge components define first and second substantially flat surfaces that engage when the first and second hinge components are in the assembled position.

7. The signal-emitting hinge of claim 6 wherein the generally cylindrical formation extends into the generally cylindrical passage as far as is possible when the first and second substantially flat surfaces engage.

8. The signal-emitting hinge of claim 6 wherein the generally cylindrical passage has a center axis that can be oriented to extend substantially vertically, whereby the substantially flat surfaces are caused to extend substantially horizontally.

9. The signal-emitting hinge of claim 8 wherein, when the center axis of the generally cylindrical passage extends substantially vertically, the weight of the second hinge component is transferred to the first hinge component by the engaging substantially flat surfaces.

10. The signal-emitting hinge of claim 9 wherein, when a gate is fastened to the second hinge component, and at least a part of the weight of the gate is transferred by the engaging substantially flat surfaces from the second hinge component to the first hinge component.

11. A signal transmitting switch, comprising:

a) a first hinge component;

b) a second hinge component that is pivotally connected to the first hinge component so the first and second hinge components can pivot relative to each other about a hinge pivot axis;

c) with a selected one of the hinge components being configured to fixedly support a housing of an energy harvesting switch that has an operator movable relative to the housing of the switch to cause a radio frequency signal to be transmitted by the switch without any need for a battery or other energy source to be connected to the switch; and d) with the non-selected other one of the hinge components being configured to move the operator of the energy harvesting switch in response to relative pivotal movement of the first and second hinge components.

12. The signal transmitting hinge of claim 11 additionally including an energy harvesting switch that has its housing fixedly connected to the selected hinge component, and that has a movable operator of the switch positioned to be moved by the non-selected other of the hinge components in response to relative pivotal movement of the first and second hinge components.

13. The signal transmitting hinge of claim 12 additionally including an upright support that carries a chosen one of the first and second hinge components, and a gate-like closure supported by the non-chosen other of the hinge components so that pivotal movement of the gate-like closure relative to the upright support will cause relative pivotal movement of the first and second hinge components to thereby cause the energy harvesting switch to wirelessly transmit a radio frequency signal.

14. A hinge comprised of first and second pivotally connected hinge components, with the first hinge component being configured to fixedly carry a housing of an energy harvesting switch, and with the second hinge component being configured to move an operator of the energy harvesting switch relative to the housing of the switch in response to relative pivotal movement of the first and second pivotally connected hinge components to cause transmission of a radio frequency signal when the operator of the switch is moved in response to relative pivotal movement of the first and second hinge components of the hinge.

15. The hinge of claim 14 wherein the first hinge component defines a generally cylindrical, substantially vertically extending passage, and the second hinge component defines an elongate, generally cylindrical formation that extends into the substantially vertically extending passage in a slip fit that permits the first and second hinge components to pivot about a substantially vertically extending center axis of the passage.

16. The hinge of claim 15 wherein each of the first and second hinge components defines a flat, substantially horizontally extending surface that engages the flat, substantially horizontally extending surface of the other of the hinge components.

* * * * *